US006497114B1

(12) United States Patent
Strikis et al.

(10) Patent No.: US 6,497,114 B1
(45) Date of Patent: Dec. 24, 2002

(54) OIL SEPARATOR

(75) Inventors: Guntis Viktors Strikis, Belleville, MI (US); Kanwal Bhatia, Troy, MI (US); Srinivas Pitla, Farmington Hills, MI (US); Vipen Khetarpal, Novi, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/954,871

(22) Filed: Sep. 18, 2001

(51) Int. Cl.[7] ..... F25B 43/02; F25B 1/00

(52) U.S. Cl. ..... 62/473; 62/84; 210/168; 494/901; 96/208

(58) Field of Search ..... 62/473, 470, 84, 62/468; 210/168, 512.1, 788; 494/901; 95/269, 271; 96/206, 208, 209; 417/222.2, 313; 418/DIG. 1, 83

(56) References Cited

U.S. PATENT DOCUMENTS

| | | | | | |
|---|---|---|---|---|---|
| 3,504,804 | A | * | 4/1970 | Newman et al. | 210/512 |
| 4,097,358 | A | * | 6/1978 | Wiseman | 204/270 |
| 4,255,099 | A | | 3/1981 | Komori | |
| 4,906,264 | A | * | 3/1990 | Szymaszek et al. | 55/324 |
| 4,996,841 | A | | 3/1991 | Meijer et al. | |
| 5,159,820 | A | | 11/1992 | Ohishi et al. | |
| 5,404,730 | A | * | 4/1995 | Westermeyer | 62/470 |
| 5,636,974 | A | | 6/1997 | Ikeda et al. | |
| 5,718,566 | A | * | 2/1998 | Ikeda et al. | 417/269 |
| 5,795,139 | A | * | 8/1998 | Ikeda et al. | 417/269 |
| 5,816,134 | A | | 10/1998 | Takenaka et al. | |
| 5,921,756 | A | | 7/1999 | Matsuda et al. | |
| 6,010,320 | A | | 1/2000 | Kwon | |
| 6,015,269 | A | * | 1/2000 | Ota et al. | 417/222.2 |
| 6,129,775 | A | * | 10/2000 | Conrad et al. | 55/337 |
| 6,134,898 | A | * | 10/2000 | Umemura et al. | 62/193 |
| 6,376,732 | B1 | * | 4/2002 | Ngan et al. | 585/800 |
| 2002/0025258 | A1 | * | 2/2002 | Ota et al. | 417/222.2 |

FOREIGN PATENT DOCUMENTS

| | | | | |
|---|---|---|---|---|
| JP | 405296611 A | * | 11/1993 | 62/470 |
| JP | 405340650 A | * | 12/1993 | 62/470 |
| JP | 406018127 A | * | 1/1994 | 62/470 |

* cited by examiner

*Primary Examiner*—Denise L. Esquivel
*Assistant Examiner*—Marc Norman
(74) *Attorney, Agent, or Firm*—Brinks Hofer Gilson & Lione

(57) ABSTRACT

An oil separator comprising a cylindrical portion, an inlet for incoming gas/oil mixture, an outlet for separated gas, a lower portion, and an outlet for separated oil is provided. The lower portion decreases in diameter as it proceeds from top to bottom, thereby providing for an increase in centrifugal force within the oil separator and greater separation of oil. The inlet traverses an upper wall of the oil separator, and preferably comprises a plurality of passageways angled with respect to the upper wall.

16 Claims, 5 Drawing Sheets

OIL SEPARATOR

FIELD OF THE INVENTION

The present invention relates to an oil separator that separates suspended-oil from a gaseous medium. More specifically, the invention relates to an oil separator having multiple angled inlets that facilitate the development of centrifugal force that achieves oil separation.

BACKGROUND OF THE INVENTION

In compressors typically used in refrigeration and air conditioning systems, such as swashplate type compressors, a mist containing lubricating oil suspended in the gaseous refrigerant medium is often discharged from the compressor. That is, the high pressure refrigerant expelled by operation of the compressor frequently comprises a mist containing droplets of oil used to lubricate the moving parts of the compressor. Due to differences in various physical properties between the oil and the refrigerant, any oil that remains suspended in the refrigerant as it travels throughout the refrigeration circuit can reduce the performance of the compressor and refrigeration system. For example, by reducing oil available to the moving parts of the compressor, the compressor is susceptible to increased wear and seizure potential. Also, oil deposits on heat exchangers can reduce their efficiency.

To combat these problems, an oil separator can be added to the refrigeration circuit, and is typically positioned between the compressor outlet and condenser inlet. The oil separator functions to separate the suspended oil from the gaseous refrigerant. Several designs have been proposed for such oil separators. For example, commonly owned U.S. patent application Ser. No. 09/775,283, hereby incorporated by reference in its entirety, describes an oil separator that utilizes a lower portion having a decreasing diameter to increase centrifugal force exerted on a gas/lubricant mixture, and therefore facilitate oil separation. The oil separator of the previous application has a single tangential inlet for the gas/refrigerant mixture.

Considering the potential effects of oil being removed from the compressor due to its suspension in the refrigerant output, there is a need to improve the state of the oil separator art.

SUMMARY OF THE INVENTION

The present invention provides an oil separator that comprises a cylindrical portion, a plurality of inlets disposed on the upper wall and angled with respect to the lengthwise axis of the oil separator, a refrigerant outlet passage having inner and outer openings, a lower portion, and an oil outlet. The lower portion provides a cross-sectional diameter that decreases as the lower portion proceeds from top to bottom. Also, the present invention provides a swashplate type compressor and a refrigeration circuit that includes such an oil separator.

DETAILED DESCRIPTION OF THE PREFERRED EMBODIMENTS OF THE INVENTION

The following description of preferred embodiments of the invention provides a detailed description of the invention. The embodiments discussed herein are exemplary in nature, and are not intended to limit the scope of the invention in any manner.

Figure 1:
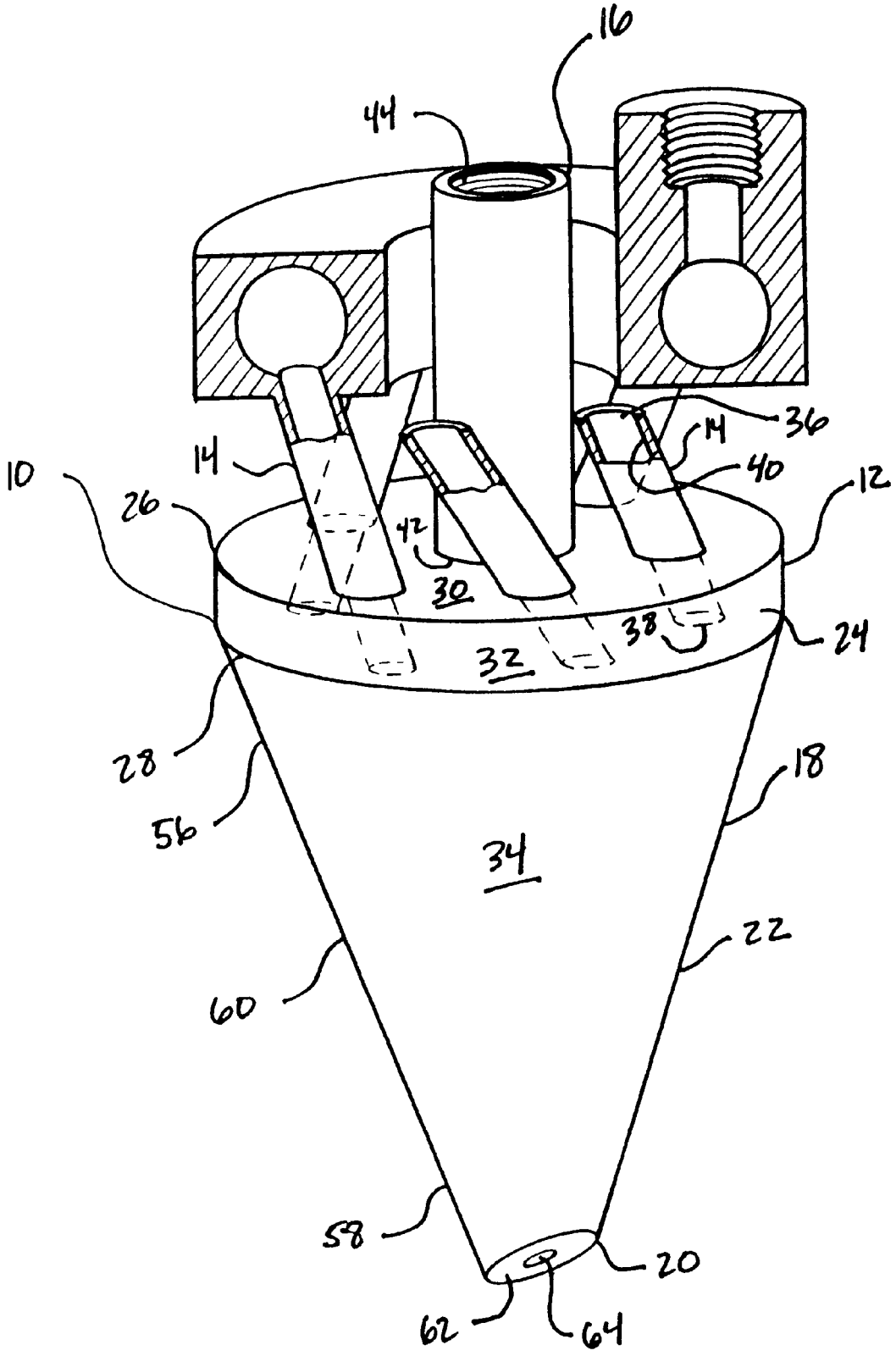
FIG. 1 is a schematic of a preferred embodiment of an oil separator in accordance with the present invention.
Figure 2:
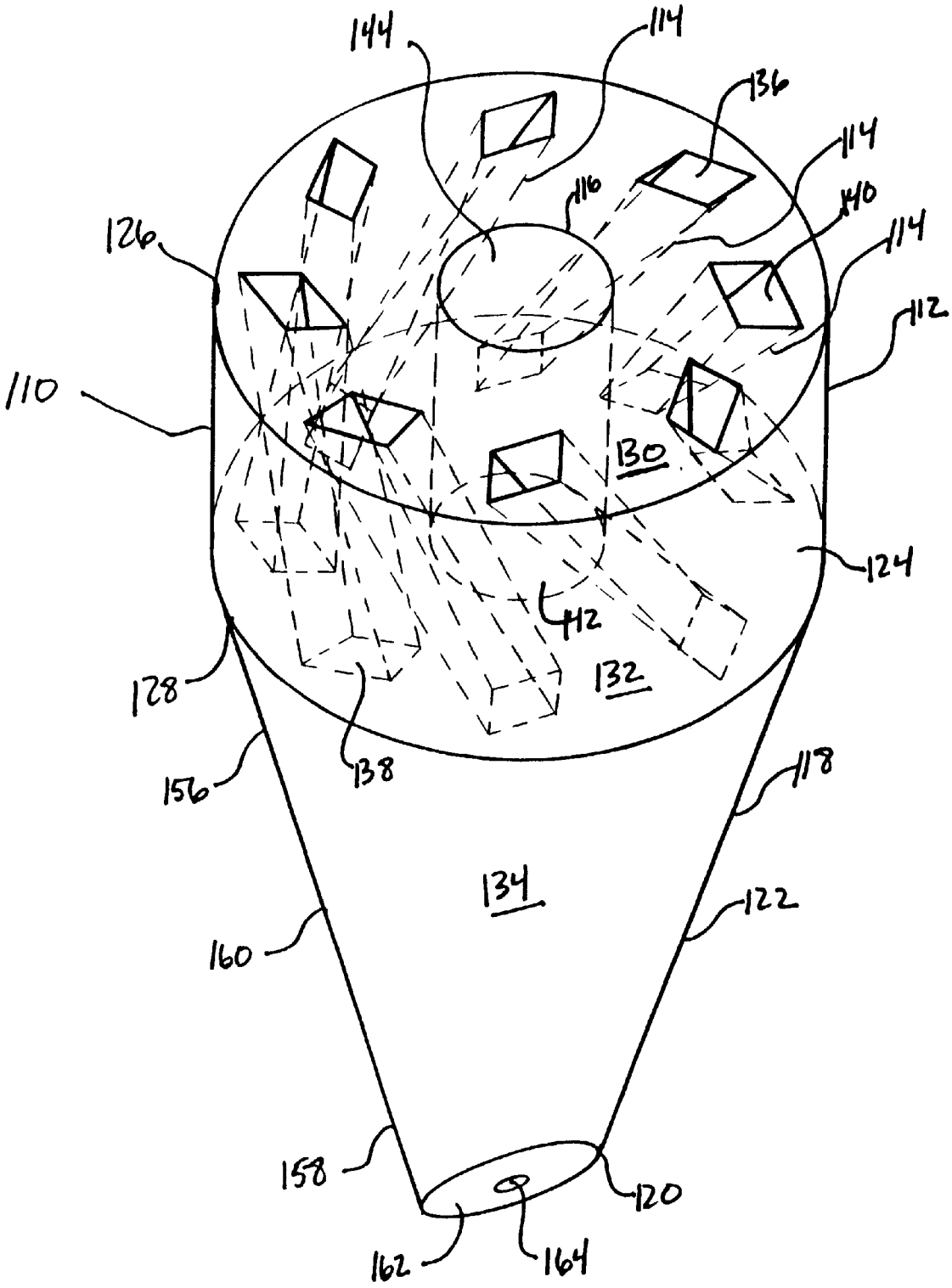
FIG. 2 is a schematic of another preferred embodiment of an oil separator in accordance with the present invention.
Figure 3:
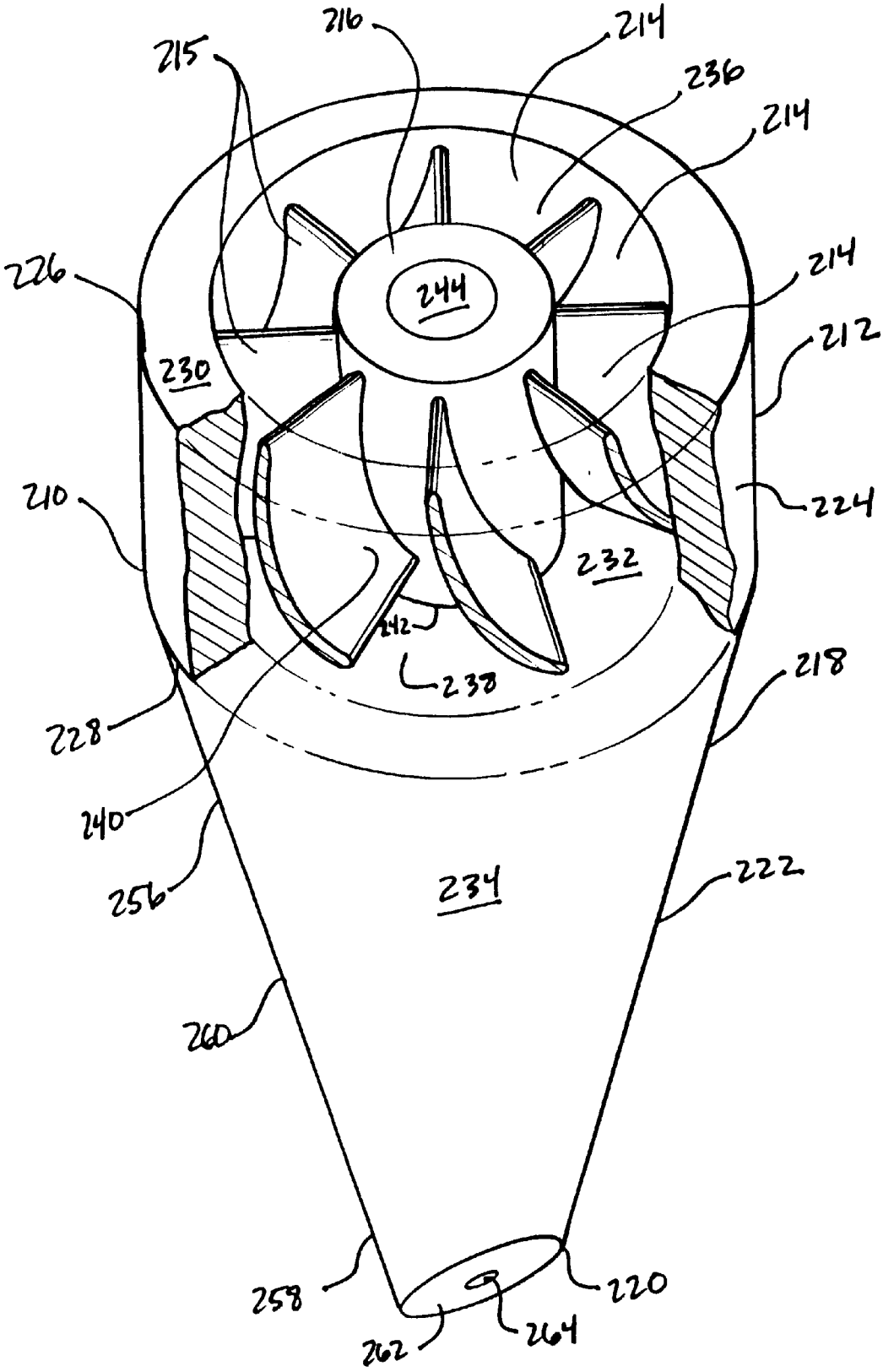
FIG. 3 is a schematic of another preferred embodiment of an oil separator in accordance with the present invention.

FIGS. 1, 2, and 3 illustrate exemplary embodiments of the oil separator of the present invention. The present invention provides an oil separator, generally indicated in the figures at reference 10. The oil separator comprises an upper portion 12, one or more inlet passages 14 connected to the upper portion 12, a first outlet passage 16, a lower portion 18, and a second outlet passage 20. Generally, a mist containing oil suspended in a gaseous medium is discharged by a compressor and enters the oil separator 10 through the inlet passage(s) 14. Upon entry at a sufficient flow rate, the mist begins to swirl downward in the upper portion 12 of the oil separator 10. The swirling creates a centrifugal force on the mist, forcing the heavier oil droplets onto the inner surface of the upper portion 12, thereby separating the oil from the refrigerant. The gaseous refrigerant is able to escape by passing through the first outlet passage 16. As the mixture continues downward within the oil separator 10, it enters the lower portion 18, where a decreasing cross-sectional diameter 22 increases the velocity of the swirl, thereby increasing the centrifugal force. The separated oil eventually exits the oil separator 10 through the second outlet passage 20.

As illustrated in FIG. 1, the upper portion 12 preferably comprises a cylindrical portion. The upper portion 12 has a circumferential wall 24 and two ends 26, 28. The first end 26 faces the exterior of the oil separator 10 and the second end 28 faces the lower portion 18. An upper wall 30 preferably closes the first end 26 of the upper portion 12, except for the inlet passage(s) 14. The second end 28 is preferably completely open. Thus, the upper portion 12 defines an open interior cavity 32. As will be developed more fully below, the lower portion 18 is in communication with the cavity 32 of the upper portion 12. Thus, the entire oil separator 10 preferably defines a main interior chamber 34 that comprises the cavity 32 of the upper portion 12 and the interior of the lower portion 18.

The inlet passage 14 is adapted to communicate with a compressor and the cavity 32 of the upper portion 12. Preferably, a plurality of inlet passage(s) 14 are defined by the upper portion 12. Particularly preferable, as illustrated in FIG. 1, the inlet passages 14 are disposed on the upper end 26 of the upper portion 12. In the preferred embodiment, illustrated in FIG. 1, each inlet 14 comprises a tubular passage having an entry 36, an exit 38, and an interior passageway 40. The entry 36 is in communication with the compressor, and the exit 38 provides the through opening by which the inlet passage 14 enters the upper portion 12. The inlet passage 14 is preferably angled with respect to the upper wall 30. As shown in FIG. 1, each tubular inlet passage 14 traverses the upper wall 30 at an angle to the plane of the upper wall 30. The presence of this angle facilitates swirling within the oil separator by ensuring that the gas and oil mixture is traveling toward the lower portion 18 and second outlet passage 20. The angle of the inlet passage with respect to the upper wall can vary, but an angle of 30–60° is preferred. Particularly preferred is an angle of approximately 45°.

FIGS. 2 and 3 illustrate oil separators having alternate forms for the inlet passages. In these figures, like references refer to similar features and/or components shown in FIG. 1. Thus, the oil separator 110 of this embodiment includes a cylindrical portion 112, and inlet passage 114, a first outlet 116, a lower portion 118, a second outlet 120, a decreasing cross-sectional diameter 122, a circumferential wall 124, a top end 126, a bottom end 128, an upper wall 130, an interior cavity 132, an interior chamber 134, an inlet entry 136, an inlet exit 138, an inlet passageway 140, an inner opening 142, an outer opening 144, a wide end 156, a narrow end 158, a taper portion 160, an annular surface 162, an a through opening 164. In FIG. 2, the inlet passage 114 comprises a slotted opening in the upper wall 130. Again, a plurality of these inlet passages 114 is preferably disposed on the upper wall 130. In the embodiment illustrated in FIG. 3, the oil separator 210 includes a cylindrical portion 212, an inlet passage 214, a first outlet 216, a lower portion 218, a second outlet 220, a decreasing cross-sectional diameter 222, a circumferential wall 224, a top end 226, a bottom end 228, an upper wall 230, an interior cavity 232, an interior chamber 234, an inlet entry 236, an inlet exit 238, an inlet passageway 240, an inner opening 242, an outer opening 244, a wide end 256, a narrow end 258, a taper portion 260, an annular surface 262, and a through opening 264. In this embodiment, the inlet passage 214 comprises an annular opening having a series of vanes 215 that divide the passage 214 into a plurality of individual passages. In both of these embodiments, the inlet passages 114, 214, are preferably angled with respect to the upper wall 130, 230, as detailed above. Preferably, the inlet passage 14 traverses the upper wall 30.

As illustrated in FIG. 1, the first outlet passage 16 allows the refrigerant to escape the oil separator 10. The first outlet passage 16 is disposed within the oil separator 10 and is in communication with both the interior chamber 34 of the oil separator 10 and the exterior of the oil separator 10. Thus, the first outlet passage 16 has inner 42 and outer 44 openings. The inner opening 42 allows communication with the interior chamber 34 of the oil separator 10, and the outer opening 44 allows communication with the exterior of the oil separator 10. Similar to the inlet passage 14, the first outlet passage 16 is preferably a tubular shaped member.

The first outlet passage 16 extends through the upper wall 30 into the interior chamber 34 of the oil separator 10. Preferably, the first outlet passage 16 extends coaxially with the axis of the upper portion 12. Alternatively, the first outlet passage 16 can be positioned at an angle to the axis. Also alternatively, the outer opening 44 of the first outlet passage 16 can be defined by the upper wall 30 of the upper portion 12 (i.e., the first outlet passage 16 does not extend beyond the upper wall).

The lower portion 18 of the oil separator is located below the upper portion 12 relative to the inlet passage 14. The lower portion 18 defines a chamber having at least one section that decreases in its cross-sectional size 22. Thus, the lower portion 18 can take on a variety of shapes, including concave, convex, bulbous, pyramidal, hyperbolic and conical forms. Preferably, as shown in the figures, the lower portion 18 comprises a conical portion. Alternatively, the lower portion 18 can comprise any shape that has at least a portion with a decreasing cross-sectional size, which allows for an increase in the velocity of the swirl within the oil separator 10. Preferably, the cross-sectional size 22 of the lower portion 18 decreases gradually, such as with a conical or bulbous shape, from the top of the lower portion 18 (i.e., the region adjacent the cylindrical portion 12) to the bottom. Alternatively, the cross-section 22 can decrease in a quantum manner, such as with a chamber having an interior stair-step profile. Also, a helical groove in the interior surface could be utilized. In the preferred embodiment, the conical portion 18 comprises a wide end 56 and a narrow end 58 with a taper portion 60 between the two ends 56, 58. The conical shape provides a gradually decreasing cross-sectional size 22 to the interior of the oil separator 10, thereby allowing the swirl of the mixture to increase in velocity as it travels downward in the oil separator 10. The wide end 56 of the conical portion 18 is in communication with the interior cavity 32 of the upper portion 12. Thus, as illustrated in FIGS. 1, 2 and 3, the interior of the entire oil separator 10, except for the refrigerant outlet, essentially comprises a hollow interior chamber 34.

The decreasing diameter of the lower portion 18 functions to increase the velocity of the swirl within the oil separator 10. In addition to a structure having a decreasing diameter, various other elements could be utilized to accomplish this function. For example, a swirling gas or fluid within the oil separator 10, a rotating blade or propeller, or a fan disposed within the oil separator could all be employed to increase the velocity of the swirl within the oil separator 10.

The narrow end 58 of the lower portion 18 defines a second outlet passage 20. The second outlet passage 20 communicates with the exterior of the oil separator 10, and provides the means by which the oil leaves the oil separator 10. When the oil separator 10 is connected to a compressor, the second outlet passage 20 is in communication with a passageway that allows the oil to ultimately return to the compressor Alternatively, the second outlet passage can be positioned at any point on the lower portion 18. It is preferred that the second outlet passage 20 be positioned within an area of the lower portion 18 at which a high degree of oil concentration occurs.

Preferably, the second outlet passage 20 comprises an annular surface 62 with a centrally located through-opening 64. Also preferable, as illustrated in FIG. 1, the second outlet passage 20 lies on a plane at an angle to the plane defined by the second end of the cylindrical portion. Alternatively, the second outlet passage 20 can be positioned parallel to this plane.

Also alternatively, the annular surface can be eliminated from the second outlet passage. In this embodiment, the second outlet passage comprises a through-opening defined by the wall of the lower portion.

Figure 4:
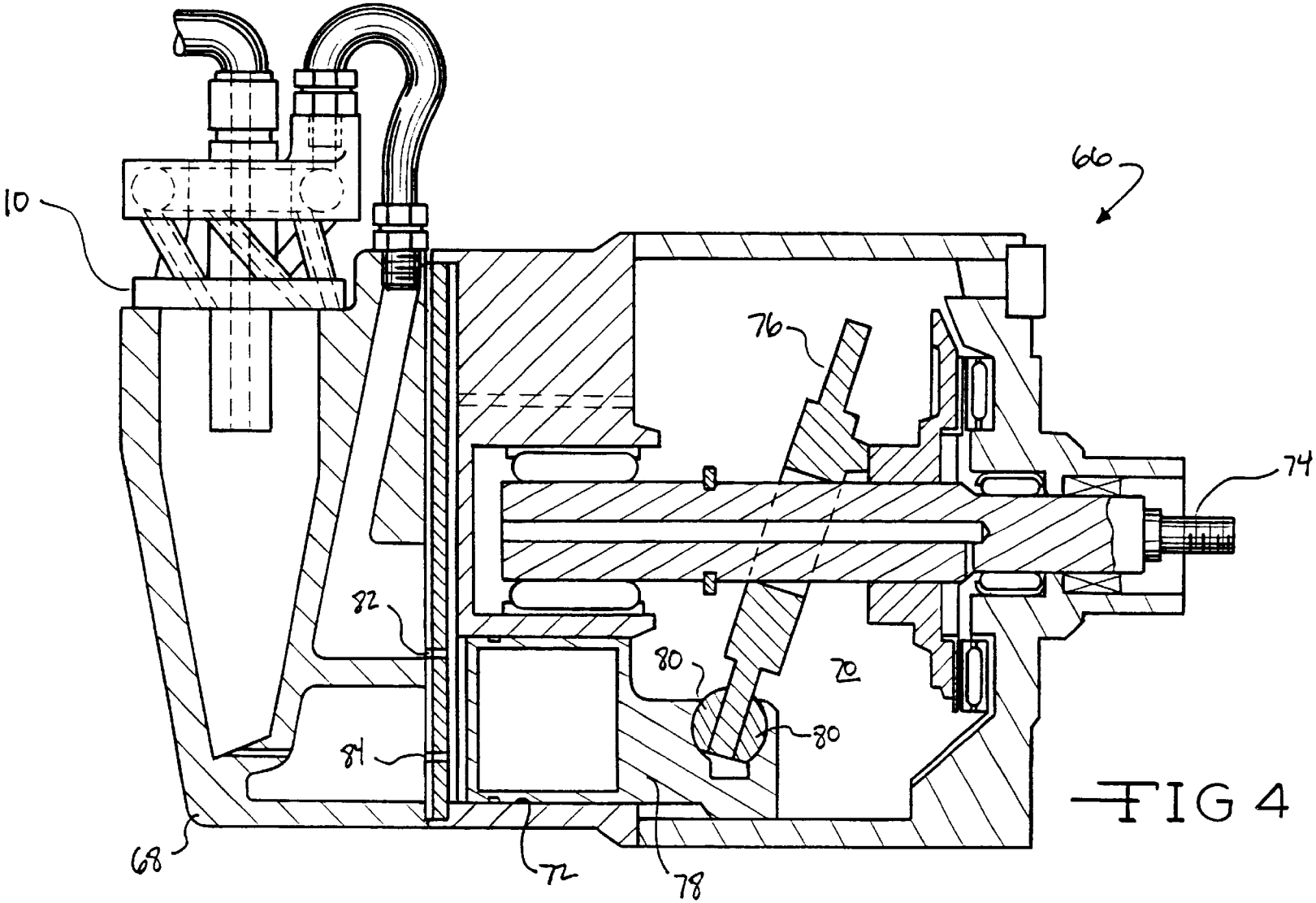
FIG. 4 is a perspective view of a swashplate type compressor that includes an oil separator in accordance with the present invention.

Oil separators in accordance with the present invention can be used in conjunction with a variety of compressors. Swashplate type compressors are frequently used in the refrigeration circuit of automobiles. These compressors are known in the art, and will not be described in detail herein. Typical swashplate compressors are described in the following U.S. Patents, each of which is herein incorporated by reference in its entirety: U.S. Pat. No. 4,996,841 to Meijer et al. for a STIRLING CYCLE HEAT PUMP FOR HEATING AND/OR COOLING SYSTEMS, U.S. Pat. No. 5,816,134 to Takenaka et al. for COMPRESSOR PISTON AND PISTON TYPE COMPRESSOR, and U.S. Pat. No. 5,921,756 to Matsuda et al. for a SWASHPLATE COMPRESSOR INCLUDING DOUBLE-HEADED PISTONS HAVING PISTON SECTIONS WITH DIFFERENT CROSS-SECTIONAL AREAS FIG. 4 illustrates a swashplate type compressor 66 incorporating the oil separator 10 of the present invention. The swashplate type compressor 66 comprises a housing 68 that defines a swashplate chamber 70 and at least one cylinder bore 72. A rotatable driveshaft 74 passes through the housing 68 and into the swashplate chamber 70. The swashplate 76 is fixedly attached to the end of the shaft 74 at an angle within the chamber 70. A piston 78 is positioned in the cylinder bore 72 and, via shoes 80, is operably connected to the swashplate 76 such that the rotational movement of the shaft 74 and connected swashplate 76 forces the piston 78 to reciprocate in a linear fashion within the cylinder bore 72. This reciprocating movement of the piston 78 results in the compression of gas contained within the cylinder bore 72 as the piston 78 moves between a top dead center position and bottom dead center position. A discharge outlet 82 is in communication with the cylinder 72 such that the compressed gas is forced into the discharge outlet 82 and can be moved into the remainder of a refrigeration circuit. Also, the compressor 66 includes an oil return inlet 84 for returning lubricating oil to the swashplate chamber 70 such that it is available for lubricating the moving parts located within the swashplate chamber 70.

The oil separator 10 is preferably positioned such that the inlet passage 14 is in communication with the discharge outlet 82 and the second outlet passage 20 is in communication with the oil return inlet 84. Also, the first outlet passage 16 is connected to the remainder of the refrigeration circuit such that the refrigerant after being separated from the oil, can be moved into the remainder of the circuit. In this fashion, a mist containing oil suspended in a gaseous refrigerant leaves the compressor 66 through the discharge outlet 82 and enters the oil separator 10 through the inlet passage 14 at a flow rate sufficient to enable swirling within the oil separator 10. While in the oil separator 10, a swirl and resultant centrifugal force are created and the oil is gradually separated from the refrigerant. The refrigerant leaves the oil separator 10 through the first outlet passage 16 and is able to travel through the rest of the refrigeration circuit. The oil gradually leaves the oil separator 10 through the second outlet passage 20, and returns to the compressor 66 through the oil return inlet 84.

The oil separator 10 of the present invention is particularly well suited for incorporation into refrigeration circuits. These circuits are well know in the art and will not be described in detail herein. Typically, such circuits include at least a compressor, a condenser, an expansion device, an evaporator, and communicative elements disposed between these elements.

Figure 5:
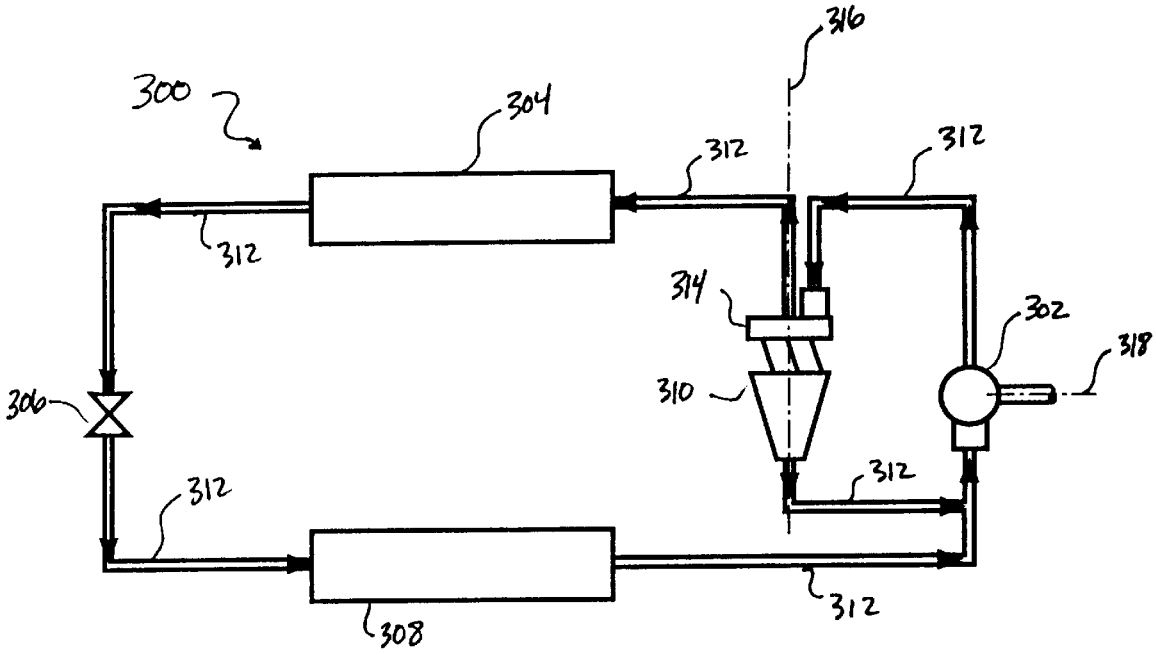
FIG. 5 is a schematic representation of a preferred embodiment of a refrigeration circuit in accordance with the present invention.

FIG. 5 illustrates a preferred embodiment of a refrigeration circuit 300 incorporating an oil separator in accordance with the present invention. The circuit includes a compressor 302, a condenser 304, an expansion valve 306, an evaporator 308, an oil separator 310 in accordance with the present invention, and communicative passageways 312 between these elements. If the oil separator 310 includes a plurality of inlet passages, as in the embodiments illustrated in FIGS. 1, 2, and 3, the circuit 300 also preferably includes a connector 314 that divides the oil and refrigerant mixture into an appropriate number of separate streams. The vanes of the inlet passage, as shown in FIG. 3, can comprise the divided passageway.

The oil separator 310 is able to generate high centrifugal force on the oil and refrigerant mixture regardless of the orientation of the oil separator 310. As a result, the oil separator 310 can be mounted at any orientation with respect to the compressor 302.

Preferably, as shown in FIG. 5, the oil separator 310 is mounted vertically with respect to the compressor 302. Particularly preferable, the oil separator 310 is mounted such that the lengthwise axis 316 of the oil separator 310 is substantially perpendicular to a lengthwise axis 318 of the shaft of the compressor 302. As used herein, the lengthwise axis 316 of the oil separator extends from the second outlet passage to the upper wall. The lengthwise axis 318 of the compressor refers to an axis extending along the line of the crankshaft of the compressor.

Figure 6:
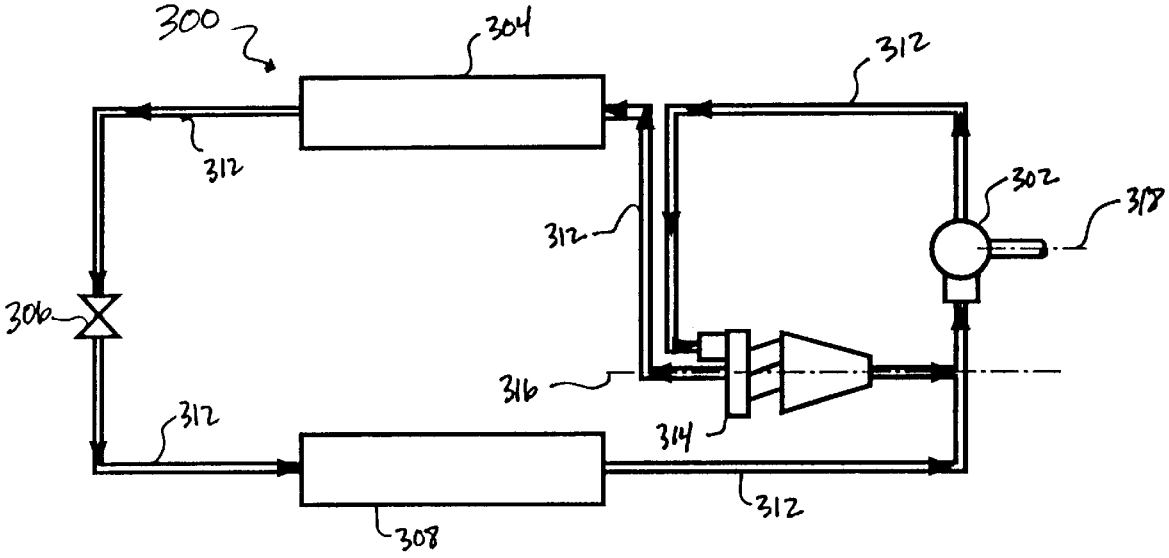
FIG. 6 is a schematic representation of an alternate embodiment of a refrigeration circuit in accordance with the present invention.

Alternatively, the oil separator 310 can be mounted at different angles with respect to the compressor 302. For example, as illustrated in FIG. 6, the oil separator 310 can be mounted horizontally. That is, the oil separator can be mounted such that its lengthwise axis 316 is substantially parallel to the lengthwise axis 318 of the shaft of the compressor 302.

The oil separator of the present invention can be formed by standard techniques, such as stamping and welding, and secured to the compressor with connections being made to the inlet passage, first outlet passage and second outlet passage.

Preferably, however, the oil separator of the present invention is integrally formed by the compressor housing. In this embodiment, the oil separator is machined into the, housing of the compressor. The communicative passageways between the compressor and the inlet, first outlet and second outlet passages can also be integrally formed by the housing. Alternatively, these communicative passageways can comprise separately attached members. The components of the oil compressor can be fabricated from steel, aluminum, or any other suitable metal or material.

The foregoing disclosure includes the best mode devised by the inventors for practicing the invention. It is apparent, however, that several variations in oil separators in accordance with the present invention may be conceivable by one skilled in the art. Inasmuch as the foregoing disclosure is intended to enable one skilled in the pertinent art to practice the instant invention, it should not be construed to be limited thereby, but should be construed to include such aforementioned variations. As such, the present invention should be limited only by the spirit and scope of the following claims.

We claim:

1. An oil separator for use in a refrigeration circuit that includes a compressor capable of discharging lubricating oil suspended in a gaseous medium, said oil separator comprising:

an upper portion having first and second ends and defining an inlet having an entry, an exit, and defining a passageway positioned at an angle with respect to the first end, the first end being closed by an upper wall;

a lower portion having upper and lower ends and defining an interior cavity in communication with the inlet of the upper portion and the cross-sectional size of the lower portion decreasing from the upper end to the lower end; and a first outlet passage disposed within the upper portion and having inner and outer openings, the inner opening being in communication with the interior cavity and the outer opening adapted to communicate with the remainder of said refrigeration circuit;

wherein the inlet comprises a plurality of distinct passageways.

2. An oil separator for use in a refrigeration circuit that includes a compressor capable of discharging lubricating oil suspended in a gaseous medium, said oil separator comprising:

an upper portion having first and second ends and defining an inlet having an entry, an exit, and defining a passageway positioned at an angle with respect to the first end, the first end being closed by an upper wall;

a lower portion having upper and lower ends and defining an interior cavity in communication with the inlet of the upper portion and the cross-sectional size of the lower portion decreasing from the upper end to the lower end; and a first outlet passage disposed within the upper portion and having inner and outer openings, the inner opening being in communication with the interior cavity and the outer opening adapted to communicate with the remainder of said refrigeration circuit;

wherein the inlet comprises a slotted passageway integrally formed by the upper wall.

3. An oil separator for use in a refrigeration circuit that includes a compressor capable of discharging lubricating oil suspended in a gaseous medium, said oil separator comprising:

an upper portion having first and second ends and defining an inlet having an entry, an exit, and defining a passageway positioned at an angle with respect to the first end, the first end being closed by an upper wall;

a lower portion having upper and lower ends and defining an interior cavity in communication with the inlet of the upper portion and the cross-sectional size of the lower portion decreasing from the upper end to the lower end; and a first outlet passage disposed within the upper portion and having inner and outer openings, the inner opening being in communication with the interior cavity and the outer opening adapted to communicate with the remainder of said refrigeration circuit;

wherein the inlet comprises an annular opening in the upper wall.

4. An oil separator in accordance with claim 3, further comprising a series of vanes separating the inlet into a plurality of passageways.

5. An oil separator in accordance with claim 4, wherein the lower portion comprises a conical shape.

6. An oil separator in accordance with claim 4, wherein the upper portion comprises a cylindrical shape.

7. A swashplate type compressor for use in a refrigeration circuit, comprising:

a housing defining a swashplate chamber and at least one axially extending cylinder bore;

a rotatable crankshaft supported by the housing and having an axis and first and second ends, the first end being external to the housing and the second end being disposed within the swashplate chamber;

a swashplate disposed on the second end of the crankshaft and within the swashplate chamber, the swashplate being fixedly mounted to the crankshaft at an angle to the axis of the rotatable crankshaft;

a piston disposed in the cylinder bore and operably connected to the swashplate such that rotational movement of the crankshaft and connected swashplate is transformed to linear reciprocating movement of the piston within the cylinder bore;

a discharge outlet in communication with the cylinder bore such that compressed gas within the cylinder bore produced by reciprocating movement of the piston is forced into the discharge outlet;

an oil return inlet for returning lubricating oil to the swashplate chamber;

an oil separator comprising an upper portion having first and second ends and defining an inlet traversing the upper wall and having an entry, an exit, and defining a communicative passageway positioned at an angle with respect to the first end, the first end being closed by an upper wall, a lower portion having upper and lower ends and defining an interior cavity, the upper end being in communication with the inlet of the upper portion and the cross-sectional size of the lower portion decreasing from the upper end to the lower end, and a first outlet passage disposed within the upper portion and having inner and outer openings, the inner opening being in communication with the interior cavity and the outer opening adapted to communicate with the remainder of said refrigeration circuit;

wherein the inlet passage comprises a slotted passageway integrally formed by the upper wall.

8. A swashplate type compressor for use in a refrigeration circuit, comprising:

a housing defining a swashplate chamber and at least one axially extending cylinder bore;

a rotatable crankshaft supported by the housing and having an axis and first and second ends, the first end being external to the housing and the second end being disposed within the swashplate chamber;

a swashplate disposed on the second end of the crankshaft and within the swashplate chamber, the swashplate being fixedly mounted to the crankshaft at an angle to the axis of the rotatable crankshaft;

a piston disposed in the cylinder bore and operably connected to the swashplate such that rotational movement of the crankshaft and connected swashplate is transformed to linear reciprocating movement of the piston within the cylinder bore;

a discharge outlet in communication with the cylinder bore such that compressed gas within the cylinder bore produced by reciprocating movement of the piston is forced into the discharge outlet;

an oil return inlet for returning lubricating oil to the swashplate chamber;

an oil separator comprising an upper portion having first and second ends and defining an inlet traversing the upper wall and having an entry, an exit, and defining a communicative passageway positioned at an angle with respect to the first end, the first end being closed by an upper wall, a lower portion having upper and lower ends and defining an interior cavity, the upper end being in communication with the inlet of the upper portion and the cross-sectional size of the lower portion decreasing from the upper end to the lower end, and a first outlet passage disposed within the upper portion and having inner and outer openings, the inner opening being in communication with the interior cavity and the outer opening adapted to communicate with the remainder of said refrigeration circuit;

wherein the inlet passage comprises an annular opening in the upper wall.

9. A swashplate type compressor in accordance with claim 8, further comprising a series of vanes separating the inlet passage into a plurality of passageways.

10. A swashplate type compressor in accordance with claim 8, wherein the lower portion comprises a conical shape.

11. A refrigeration circuit, comprising:

a swashplate type compressor discharging lubricating oil suspended in a gaseous medium, said compressor comprising a housing defining a swashplate chamber and at least one axially extending cylinder bore, a rotatable crankshaft supported by the housing and having an axis and first and second ends, the first end being external to the housing and the second end being disposed within the swashplate chamber, a swashplate disposed on the second end of the crankshaft and within the swashplate chamber, the swashplate being fixedly mounted to the crankshaft at an angle to the axis of the rotatable crankshaft, a piston disposed in the cylinder bore operably connected to the swashplate such that the rotational movement of the crankshaft and connected swashplate is transformed to linear reciprocating movement of the piston within the cylinder bore, a discharge outlet in communication with the cylinder bore such that compressed gas within the cylinder bore produced by the reciprocating movement of the piston is forced into the discharge outlet, an oil return inlet for returning lubricating oil to the swashplate chamber of said compressor;

a condenser operably connected to the compressor; and an oil separator comprising an upper portion having a first end closed by an upper wall and a second end and defining an inlet traversing the upper wall and having an entry, an exit, and defining a communicative passageway positioned at an angle with respect to the first end, a lower portion having upper and lower ends and defining an interior cavity, the upper end being in communication with the inlet of the upper portion and the cross-sectional diameter of the lower portion decreasing from the upper end to the lower end, a first outlet passage disposed within the upper portion and having inner and outer openings, the inner opening being in communication with the interior cavity and the outer opening being in communication with the remainder of said refrigeration circuit, and a second outlet passage in communication with the oil return inlet of the compressor.

12. A refrigeration circuit in accordance with claim 11, wherein the oil separator is positioned vertically with respect to lengthwise axis of the crankshaft of the compressor.

13. A refrigeration circuit in accordance with claim 12, wherein the oil separator is positioned such that the lengthwise axis of the oil separator is perpendicular to the lengthwise axis of the crankshaft of the compressor.

14. A refrigeration circuit in accordance with claim 11, wherein the lengthwise axis of the oil separator is substantially parallel to the lengthwise axis of the crankshaft of the compressor.

15. A refrigeration circuit according to claim 11, wherein the lower portion comprises a conical portion having a wide end and a narrow end, the wide end being in communication with the second end of the upper portion.

16. A refrigeration circuit according to claim 11, wherein the housing of the compressor integrally forms the upper portion and lower portion of the oil separator.

* * * * *